US005718596A

United States Patent [19]

Inaba et al.

[11] Patent Number: 5,718,596

[45] Date of Patent: Feb. 17, 1998

[54] CONNECTOR ENGAGING STRUCTURE

[75] Inventors: Shigemitsu Inaba; Nobuyuki Akeda; Akira Maeda; Toshifumi Matsuura, all of Shizouka, Japan

[73] Assignee: Yazaki Corporation, Tokyo, Japan

[21] Appl. No.: 747,042

[22] Filed: Nov. 12, 1996

[30] Foreign Application Priority Data

Nov. 9, 1995 [JP] Japan ..... 7-291267

[51] Int. Cl.[6] ..... H01R 13/627

[52] U.S. Cl. ..... 439/352; 439/357

[58] Field of Search ..... 439/350, 352, 439/353, 354, 357, 358, 270–273

[56] References Cited

U.S. PATENT DOCUMENTS 5,082,455 1/1992 Wei ..... 439/352
5,176,553 1/1993 Sakurai et al. ..... 439/352
5,254,013 10/1993 Tanaka ..... 439/282 X
5,603,631 2/1997 Kawahara et al. ..... 439/352

*Primary Examiner*—Khiem Nguyen
*Attorney, Agent, or Firm*—Sughrue, Mion, Zinn, Macpeak & Seas, PLLC

[57] ABSTRACT

A connector engaging structure which prevents male and female connectors from being insufficiently engaged with each other, and which positively prevents the connector housing from being damaged. The connector engaging structure 1 is designed as follows. In engaging a second connector 3 with a first connector 2, a cantilevered arm 44 formed in an outer housing, which is a part of the second connector, is locked to a locking protrusion 16 of the first connector. Next, a locking arm 25 forming an inner housing 21, which is a part of the second connector 3, is engaged with an engaging groove 15 formed in the first connector 2. With the outer housing 22 moved by the elastic force of a spring member 35, the lock arm 25 is held down so that the first and second connectors are completely engaged with each other.

9 Claims, 8 Drawing Sheets

CONNECTOR ENGAGING STRUCTURE

BACKGROUND OF THE INVENTION

1. Field of the Invention

This invention relates to the engaging structure for male and female connectors of a direct engagement type which is used for directly connecting a variety of electronic devices to electric wires, and more particularly to a connector engaging structure for positively and fixedly engaging a male connector and a female connector to each other.

2. Related art

Recently, a number of electronic devices for a variety of control operations have been mounted on an automobile. In this connection, a number of connectors for connecting electronic devices to wire harnesses, and a number of connectors for connecting wire harnesses to one another have been used in the automobile. Those connectors are connector assemblies each of which comprises a male connector and a female connector which are engaged with each other for electrical connection of the pertinent electrical components.

In the connection of the male and female connectors, it is essential that the connectors be completely engaged with each other. If they are incompletely engaged with each other, they may become disengaged from each other during use. If this occurs, then the associated electronic device will not work, and, for instance, the automobile may not operate. In order to overcome this difficulty, a variety of connector engaging structures have been proposed in the art which function to positively engage the male and female connectors with each other.

One example of a conventional connector engaging structure will be described with reference to Japanese Utility Patent (OPI) No. 43484 (the term "OPI" as used herein means an "unexamined published application") entitled "Connector Fixedly Engaging Unit".

The conventional connector engaging unit, as shown in FIG. 12 of the subject application, comprises a receptacle X and a connector plug Y. The receptacle X includes a cylindrical receptacle shell 61. A ferrule 63, and a spring member 64 for urging the ferrule 63 are held between a socket front insulator 62 and a socket rear insulator 65. The insulators 62 and 65 are accommodated in the receptacle shell 61 with the aid of a ring 66. In addition, a first engaging section, namely a locking spring 75, is formed on the inner cylindrical surface of the receptacle shell 61.

The connector plug Y includes a cylindrical barrel 69. A ferrule 63, and a spring member 77 for urging the ferrule forwardly, are also held between a front insulator 71 and the rear insulator 65. The insulators 71 and 65 are accommodated in the barrel 69 with the aid of a ring 66. A first locking section, namely a protrusion 69*a*, is formed on the outer cylindrical surface of the barrel 69 near the engaging end thereof. The protrusion 69*a* is engaged with the locking spring 75 when the receptacle is engaged with the connector plug. In addition, a barrel groove 69*b* is formed in the outer cylindrical surface of the barrel 69 in such a manner that it is located behind the protrusion 69*a*.

The barrel 69 is inserted in a cylindrical coupling 67, which is an engagement control member. A sliding ring 68 is fitted in the coupling 67. In addition, the connector plug Y includes a rear washer 72 which is fitted inside of the slide ring 68 and is fixed with a retainer 73, and a spring 70 which is interposed between the slide ring 68 and the washer 71 to urge the slide ring 68 and the coupling 67 forwardly.

The receptacle X and the connector plug Y are engaged with each other by pushing the plug Y against the receptacle X. In this operation, the locking spring 75 of the receptacle shell 61 is outwardly deformed, being pushed against the protrusion 69*a* of the barrel 69. As a result, the rear end of the receptacle shell 61 is pushed against the slide ring 68 forming the spring in the backward direction to thereby compress the spring 70.

As the insertion is further advanced, the locking spring 75 of the receptacle shell 61 is caused to pass over the protrusion 69*a* of the barrel 69, thus being received in the barrel groove 69*b*. As a result, the slide ring 68 is released from the locking spring 75, so that the slide ring 68 is urged by the elastic force of the spring 70 forwardly. As a result, a locking state is attained in that outward movement of the locking spring 75 is suppressed by the slide ring 68. Thus, engagement is accomplished, with the engagement of the locking spring 75 with the protrusion being maintained.

The above-described connector engaging unit is designed so that when the engagement of the receptacle X with the connector plug Y is insufficient, the plug Y is pushed out by the elastic force of the spring 70. Accordingly, it is only when the plug X and the receptacle Y are completely engaged with each other, that the locking spring 75 pressing the slide ring 68 is retained, so that the receptacle X and the connector plug Y are maintained engaged with each other.

In this connection, it should be noted that the locking spring 75 is provided on the side of the receptacle X; that is, the receptacle X includes the spring 75. Therefore, in the case where the receptacle X has been directly coupled, for instance, to the gear box of an automobile, in order for the connector plug Y to be engaged with or disengaged from the receptacle X, it is necessary to apply a great force. Therefore, the receptacle X or the connector plug Y may be broken.

Hence, it is necessary to increase the mechanical strength of the connector housing. For this purpose, the material of the connector housing is a synthetic resin which is mixed with glass powder. It is true that employment of the synthetic resin mixed with glass powder increases the mechanism strength of the connector housing; however, the resultant housing has a decreased flexibility, which makes it impossible to form the locking spring in the receptacle. Hence, there are competing factors to be addressed.

In view of the foregoing, an object of the invention is to provide a connector engaging structure which, on the one hand, prevents male and female connectors from being insufficiently engaged with each other, and the other hand, positively prevents the connector housing from being damaged.

SUMMARY OF THE INVENTION

The foregoing object of the invention has been achieved by the provision of a connector engaging structure comprising:

a first connector including connector terminals fixedly secured to a base board which is directly mounted on a desired electronic device or the like, a cylindrical wall which surrounds the connector terminals, an engaging groove formed in one end portion of the outer cylindrical surface of the wall, and a locking protrusion formed on one end portion of an outer side surface of the wall; and a second connector including an inner housing having connector terminals which are electrically connected to the connector terminals of the first connector, and a lock arm which, when the second connector is engaged with the first connector, engages with the engaging groove, and an outer housing which is slidable on the outer surface of the inner housing in a direction of engagement, and has a cantilevered arm which, when the second connector is engaged with the first connector, is locked to the locking protrusion, in which, according to the invention, the inner housing has a cantilevered arm push-up protrusion at one end thereof which releases the locking of the cantilevered arm to the locking protrusion during engagement.

Furthermore, in the connector engaging structure, when the lock arm is engaged with the engaging groove, the outer housing is slid in the direction of engagement, to hold down the lock arm in the engaging groove.

Moreover, in the connector engaging structure, the sliding of the outer housing is effected by a spring member interposed between the inner housing and the outer housing.

In engaging the second connector with the first connector, the lock arm of the second connector is abutted against the cylindrical wall of the first connector, while the cantilevered arm of the outer housing is locked to the locking protrusion formed on the wall of the first connector, so that the sliding of the outer housing is temporarily inhibited. As the second connector is further pushed in, the lock arm is engaged with the engaging groove, while the cantilevered arm push-up protrusion acts on the cantilevered arm to release the locking of the cantilevered arm to the locking protrusion.

Hence, the outer housing is moved in the direction of engagement by means of the spring member, so that the lock arm is held down in the engaging groove, whereby the first and second connectors are positively engaged with each other.

DETAILED DESCRIPTION OF THE INVENTION

A connector engaging structure, which constitutes a preferred embodiment of the invention, will be described with reference to FIGS. 1 through 11. First, the arrangement of each of first and second connectors will be described, and then the engagement of those connectors will be described.

Figure 1:
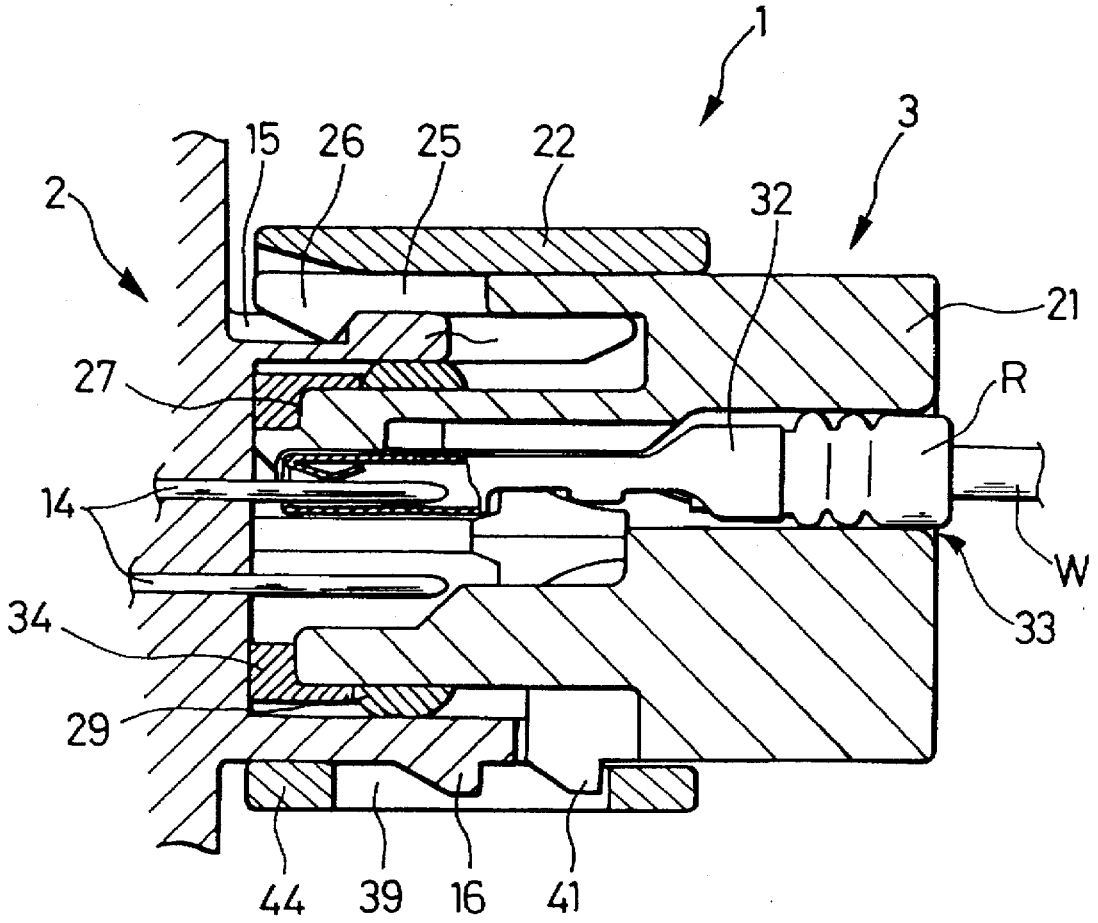
FIG. 1 is a sectional view of a connector engaging structure, which constitutes a preferred embodiment of the invention.

Roughly stated, as shown in FIG. 1, the connector engaging structure 1 of the invention comprises a first connector, namely, a male connector 2; and a second connector, namely, a female connector 3.

Now, the structure of each of the first and second connectors 2 and 3 will be described.

Figure 2:
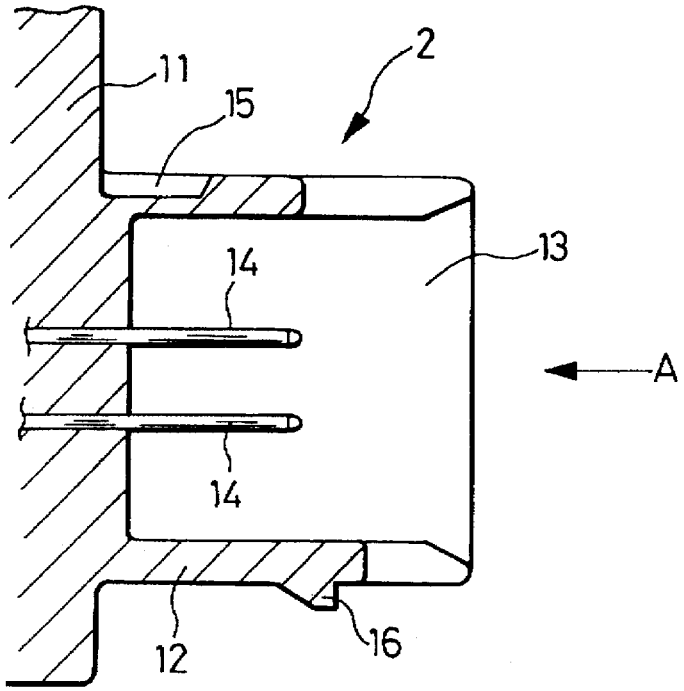
FIG. 2 is a sectional view showing a male connector in the connector engaging structure shown in FIG. 1.

The male connector 2 is as shown in FIG. 2. The male connector 2 is fixedly secured to an electronic device, gear box, etc., and is formed by molding glass-mixed resin material. The male connector 2 is substantially in the form of a cylinder and includes a base board 11 which is secured, for instance, to the electronic device (not shown) and a cylindrical wall 12 which is formed integral with the base board 11 and which defines an internal space 13 into which the female connector 3 (described belwo) is inserted in the direction of the arrow A.

A plurality of connector terminals 14 are fixedly secured to the base board 11 in such a manner that one end portion of each of the connector terminals 14 is connected to the relevant electronic device, and the other end portion extends into the internal space 1. The cylindrical wall 12 has an elongated engaging groove 15 in the outer cylindrical surface at the base end, and an engaging protrusion 16 at the end opposite to the base end.

Figure 3:
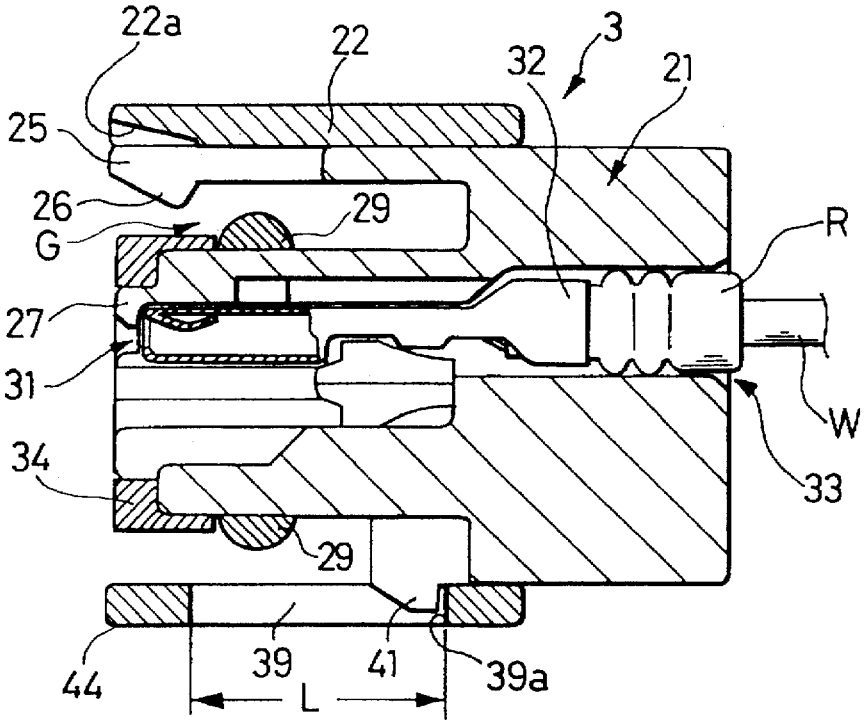
FIG. 3 is a sectional view taken along line 3—3 of FIG. 4 showing a female connector in the connector engaging structure shown in FIG. 1.
Figure 5:
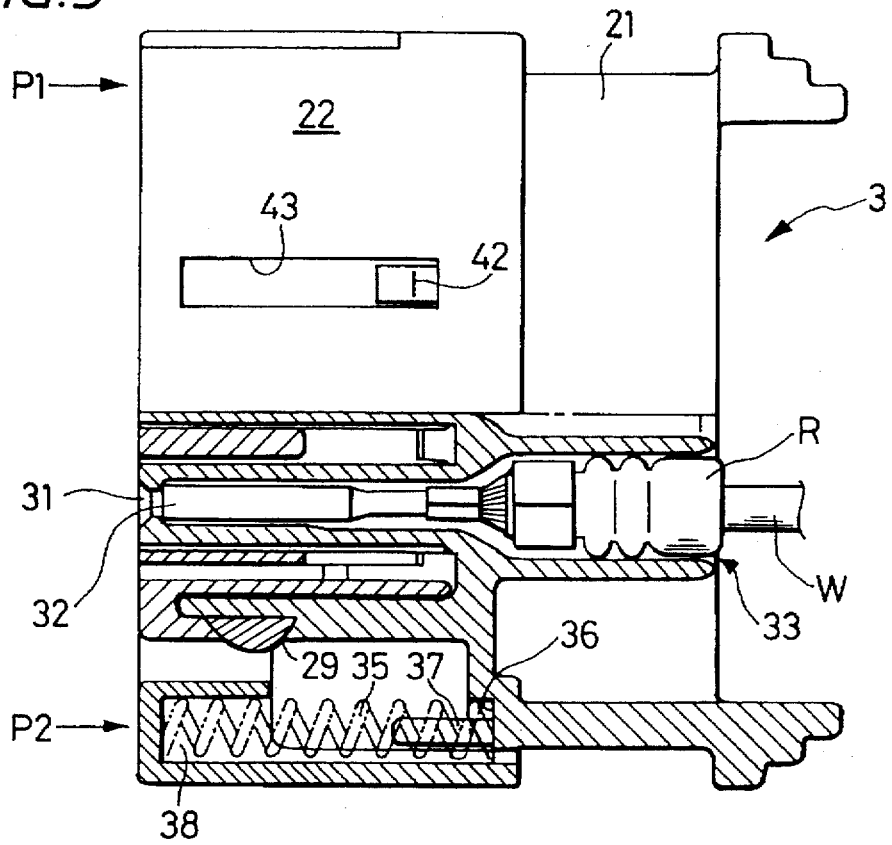
FIG. 5 is a sectional view taken along line 5—5 in FIG. 4 for a description of the structure of the female connector shown in FIG. 3.
Figure 6:
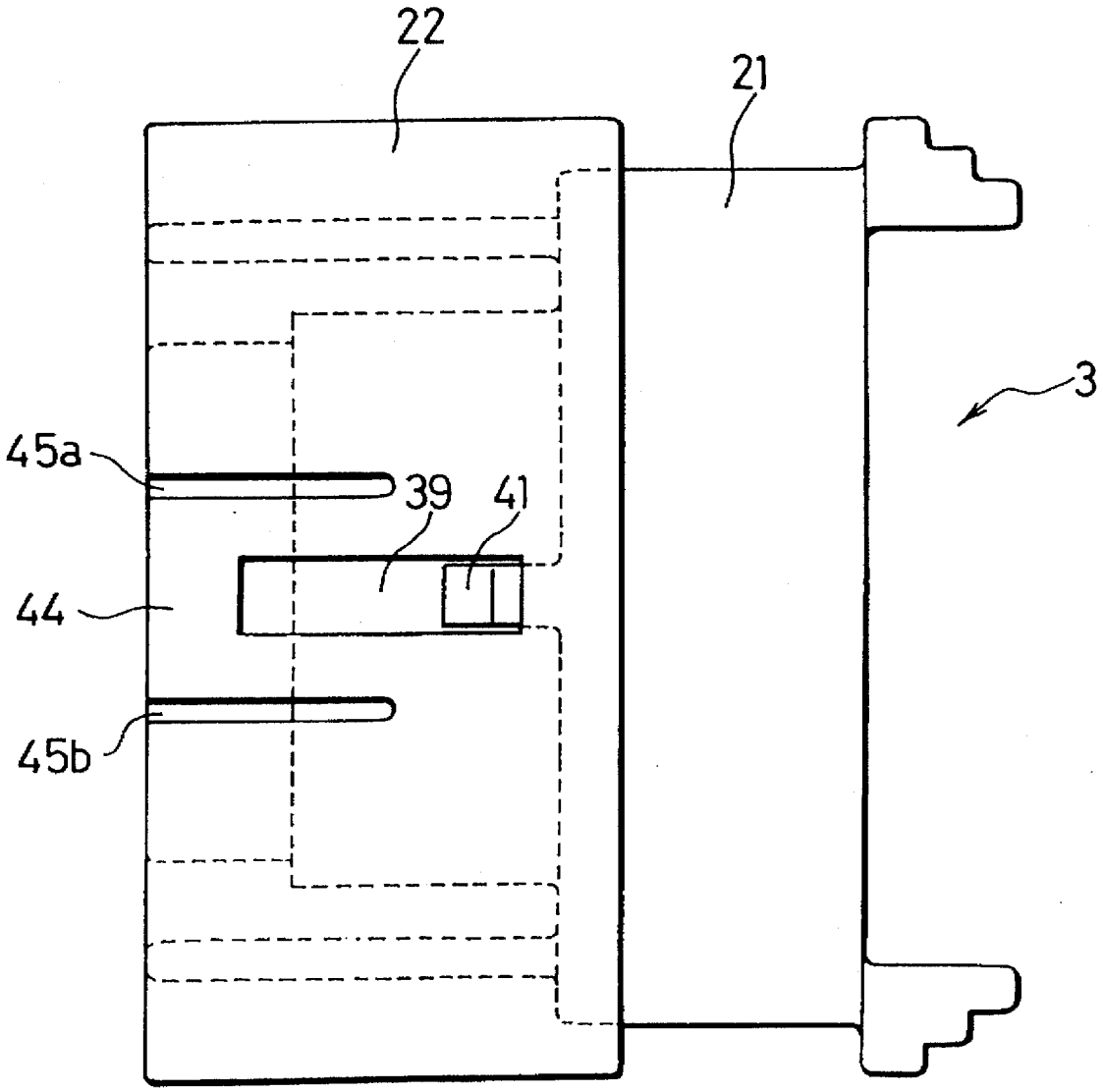
FIG. 6 is a bottom view for a description of the structure of the female connector shown in FIG. 3.

Now, the structure of the female connector 3 will be described with reference to FIGS. 3 through 6. FIG. 3 is a sectional view taken along the line 3—3 in FIG. 4, showing the internal structure of the female connector, FIG. 4 is a plan view showing the engagement surface of the female connector 3, FIG. 5 is a sectional view taken along the line 5—5 in FIG. 4, and FIG. 6 is a bottom view of the female connector.

The female connector 3, as shown in FIG. 3, comprises an inner housing 21 which surrounds the wall 12 of the male connector 2 when the female connector 3 is engaged with the latter 2 and an outer housing 22 which is longitudinally movable on the outer cylindrical surface of the inner housing 21.

Figure 4:
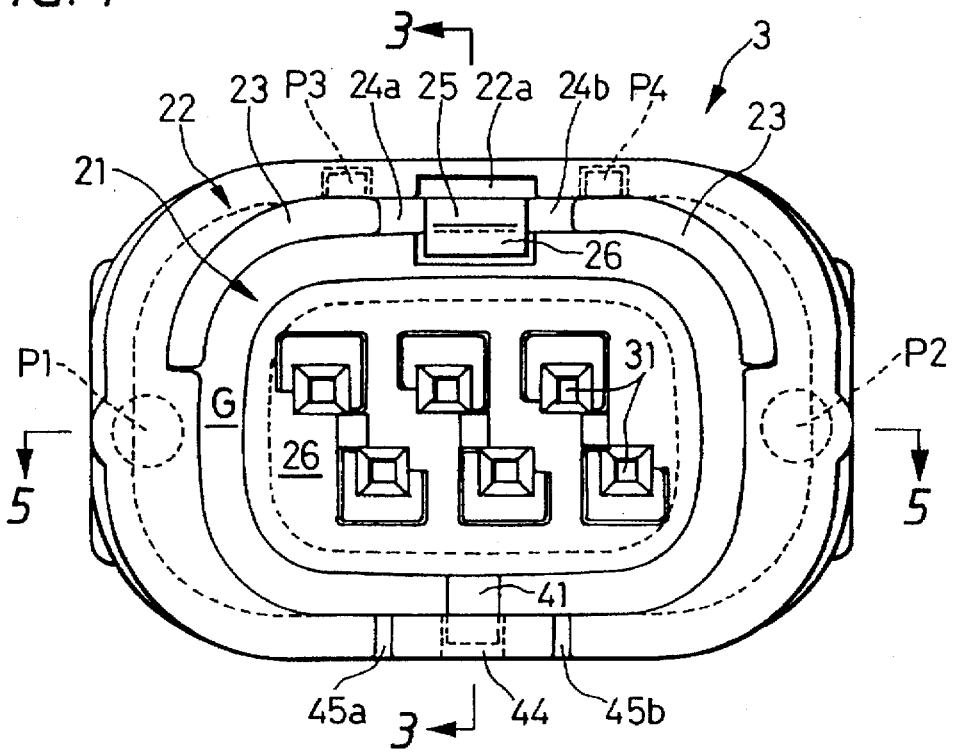
FIG. 4 is a front view of the female connector shown in FIG. 3.

As shown in FIG. 4, the inner housing 21 has an embossed portion 23 in its upper portion. The embossed portion 23 has a centrally disposed lock arm 25 at the middle which is elastic with the aid of slits 24*a* and 24*b*. The end portion of the lock arm 25 is formed into an engaging protrusion 26.

As shown in FIG. 3, the inner housing 21 has a protruded inserting section 27 at the center. The inserting section 27, the embossed portion 23, and the outer housing 22 define a gap G into which the cylindrical wall 12 of the male connector 2 is inserted. A water-proof member 29 of rubber, or the like, is fixedly mounted on the inserting section 27.

In the embodiment, the inserting section 27 has six terminal accommodating chambers 31, in which female connector terminals 32 are inserted which are connected to wires W on which rubber plugs R are mounted. The terminal accommodating chambers 31 are communicated with wire extending outlets 33, respectively, through which the wires W are extended outside.

As shown in FIGS. 4 and 5, spring members 35 are provided in the female connector 3 behind positions P1 and P2 (indicated as dotted-line circles) (i.e., at both ends as viewed horizontally in FIG. 4), in such a manner that the inner housing 21 and the outer housing 22 are urged away from each other.

The spring member 35 at the position P2 will be described with reference to FIG. 5. One end portion of the spring member 35 is engaged with a recess-shaped engaging portion 36 formed in the inner housing 21. More specifically, the end of the spring is mounted on a bar-shaped locking protrusion extending from the engaging portion 36. The other end portion of the spring member 35 is engaged with an engaging portion 38 formed in the outer housing 22. Hence, the inner housing and the outer housing 22 are urged by the spring member 35 in the opposite directions at all times.

As shown in FIG. 3, a slide hole 39 having a predetermined length L is formed in the lower central portion of the outer housing 22. In correspondence to the slide hole of the outer housing 2, a cantilevered arm push-up protrusion 41 is formed in the outer housing in such a manner that it extends into the slide hole 39.

As shown in FIG. 5, the inner housing 21 has a guide protrusion 42 in the upper portion which is engaged with a guide groove 43 formed in the outer housing, so that the outer housing 22 is smoothly slidable to the right in FIG. 5.

As shown in FIG. 6, the outer housing 22 has a pair of slits 45*a* and 45*b* in the lower portion in such a manner that they are located on both sides of the aforementioned slide hole 39. The portion defined by the slits 45*a* and 45*b* serves as a cantilevered arm 44.

Now, the engagement of the male connector 2 and the female connector 3 will be described.

Figure 7:
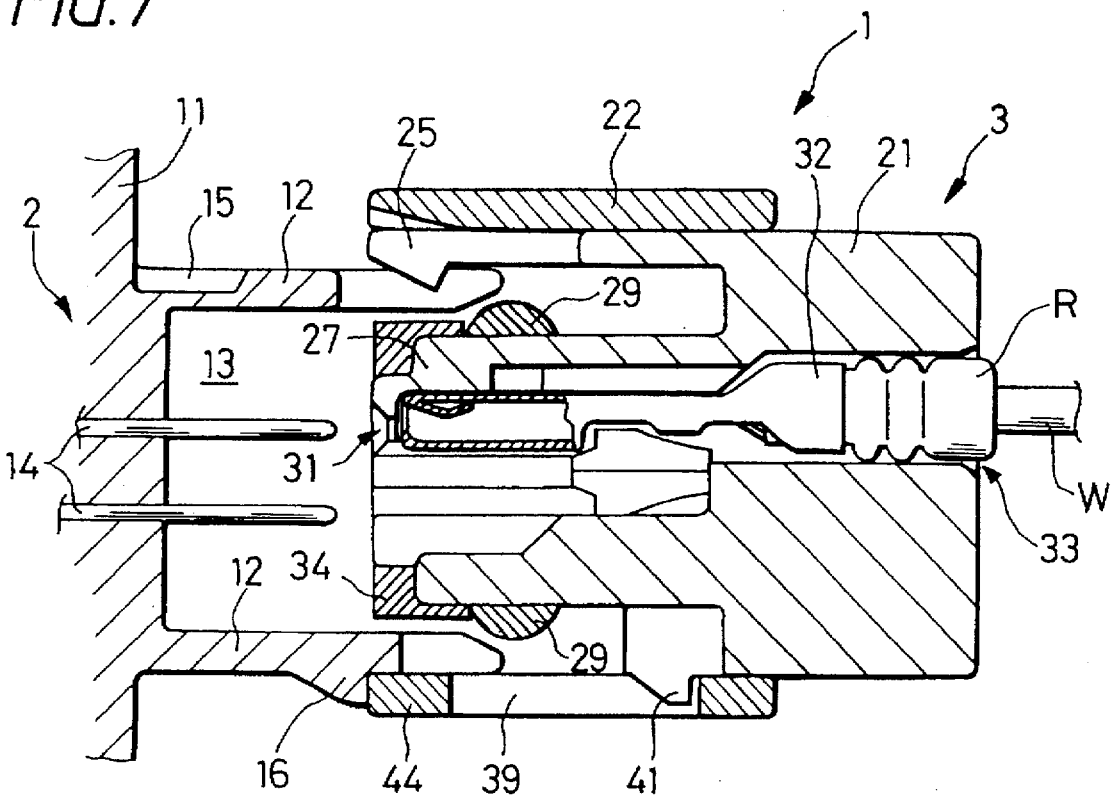
FIG. 7 is a sectional view for a description of the engagement of the male and female connectors.

As shown in FIG. 7, in the case where the male connector 2 and the female connector 3 are engaged with each other, the outer housing 22 of the female connector 3 is located outside the cylindrical wall 12 of the male connector 2. When the female connector 3 is further pushed to the left in FIG. 7, the end portion of the cantilevered arm 44 formed in the end portion of the outer housing, is abutted against the engaging protrusion 16 formed on the cylindrical wall 12 of the male connector 2, thus stopping the movement of the outer housing 22 of the female connector 3.

In this connection, the locking action of the spring member 35 must be considered. That is, as noted above, the spring member 35 urges the inner housing 21 and the outer housing 22 in the opposite directions. Since the outer housing 22 abuts against the locking protrusion 16, it is impossible to further move the outer housing inward. On the other hand, the inner housing 21 is pushed to the left in FIG. 7 causing the spring member 35 to be compressed.

Figure 8:
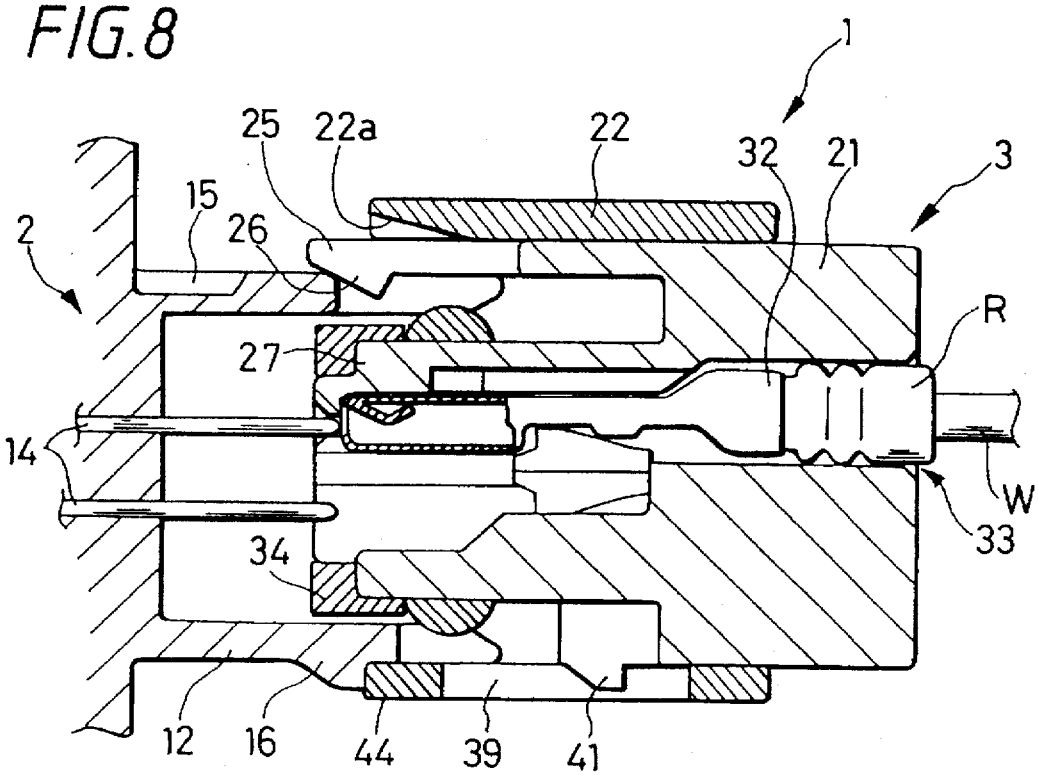
FIG. 8 is a sectional view for a description of the behavior of the male and female connectors during the engagement of those connectors.

When, as shown in FIG. 8, the inner housing 21 is thus moved to the left, the inserting section 27 is received in the internal space 13, while the cantilevered arm push-up protrusion is moved to the left. Further, as the inner housing 21 is pushed to the left, the engaging protrusion 26 of the lock arm 25 is brought into contact with the end of the cylindrical wall 12 of the male connector 12.

Figure 9:
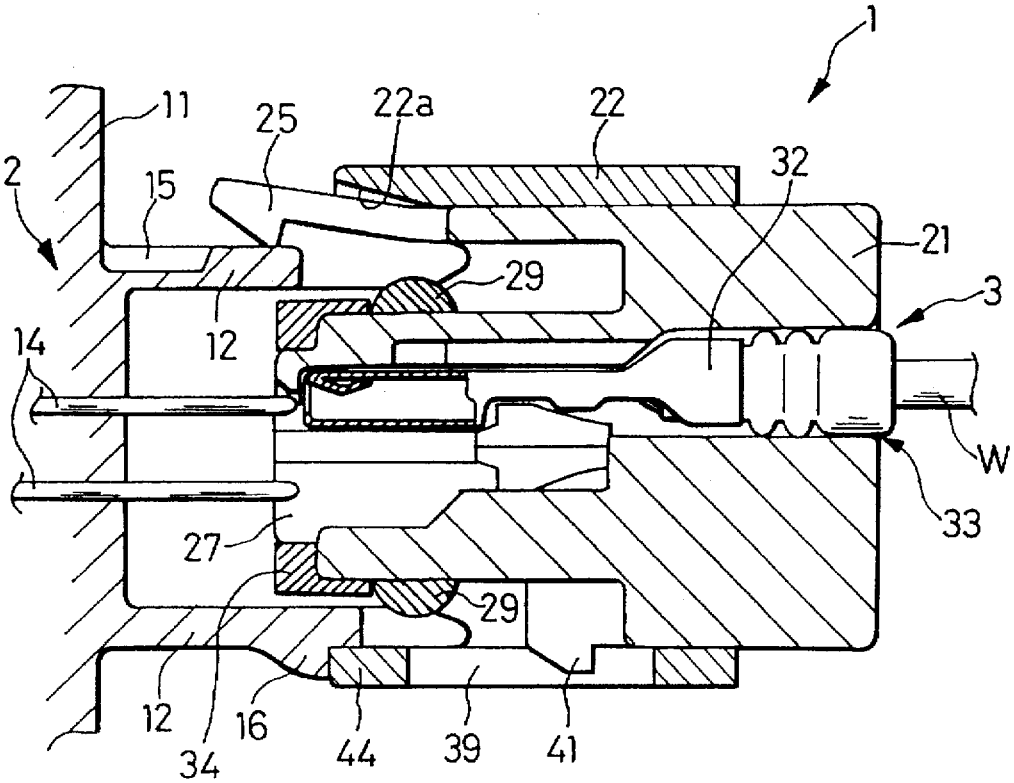
FIG. 9 is a sectional view for a description of the function of a lock arm during the engagement of the connectors.

In this connection, it should be noted that the lower portion of the engaging protrusion 26 is sloped. Hence, as the inner housing 21 is being pushed in, the lock arm 25 is elastically deformed, thus being disposed along the wall 12 as shown in FIG. 9. At this time, the cantilevered arm push-up protrusion 41 is positioned substantially at the middle of the slide groove 39. The front end portion of the outer housing 22 has a tapered surface 22*a* to allow the deformation (deflection) of the lock arm 25.

Figure 10:
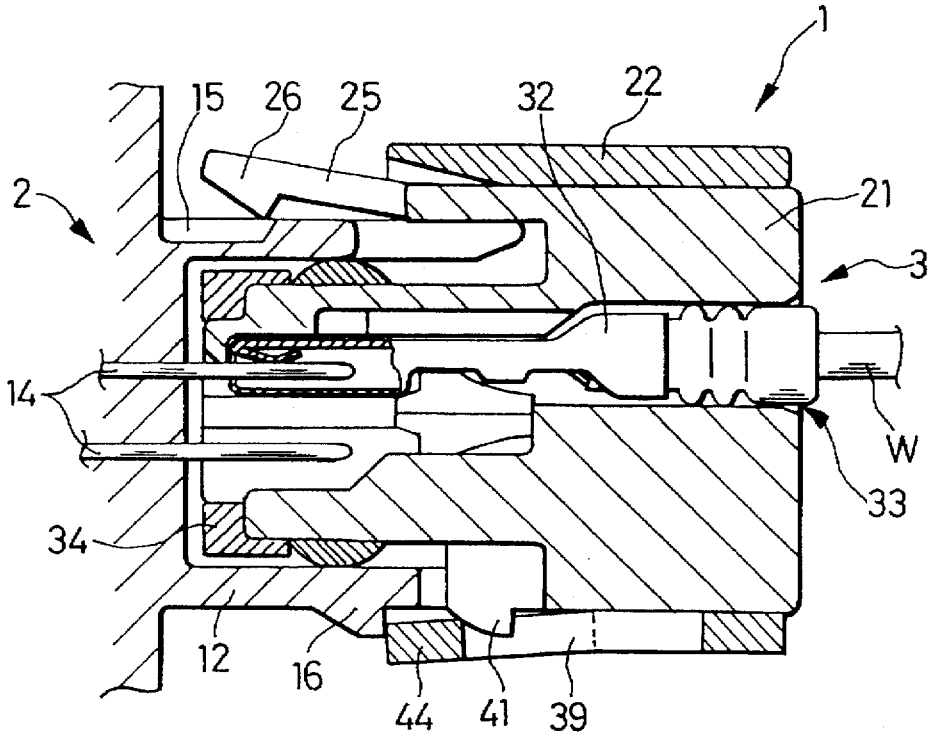
FIG. 10 is a sectional view for a description of the behavior of the lock arm and a cantilevered arm.

Finally, when the inner housing is further pushed to the left, as shown in FIG. 10 the lock arm 25 slides beyond the cylindrical wall 12, thus reaching the engaging groove 15. At this time, the cantilevered arm push-up protrusion 41 is moved by a distance L, thus abutting against the cantilevered arm 44 from the side of the slide groove 39. In this case, since the surface of the cantilevered arm push-up protrusion 41, which is confronted with the cantilevered arm 44, is curved, the cantilevered arm 44 is raised thereby.

If, under this condition, the pushing of the inner-housing 21 is suspended, the inner housing 21 will automatically return to the right as a result of the elastic force of the spring member 35 (see FIG. 5). Accordingly, it can be easily detected from the return of the inner housing 21 that the engagement of the male connector 2 and the female connector 3 with each other is unsatisfactorily.

Figure 11:
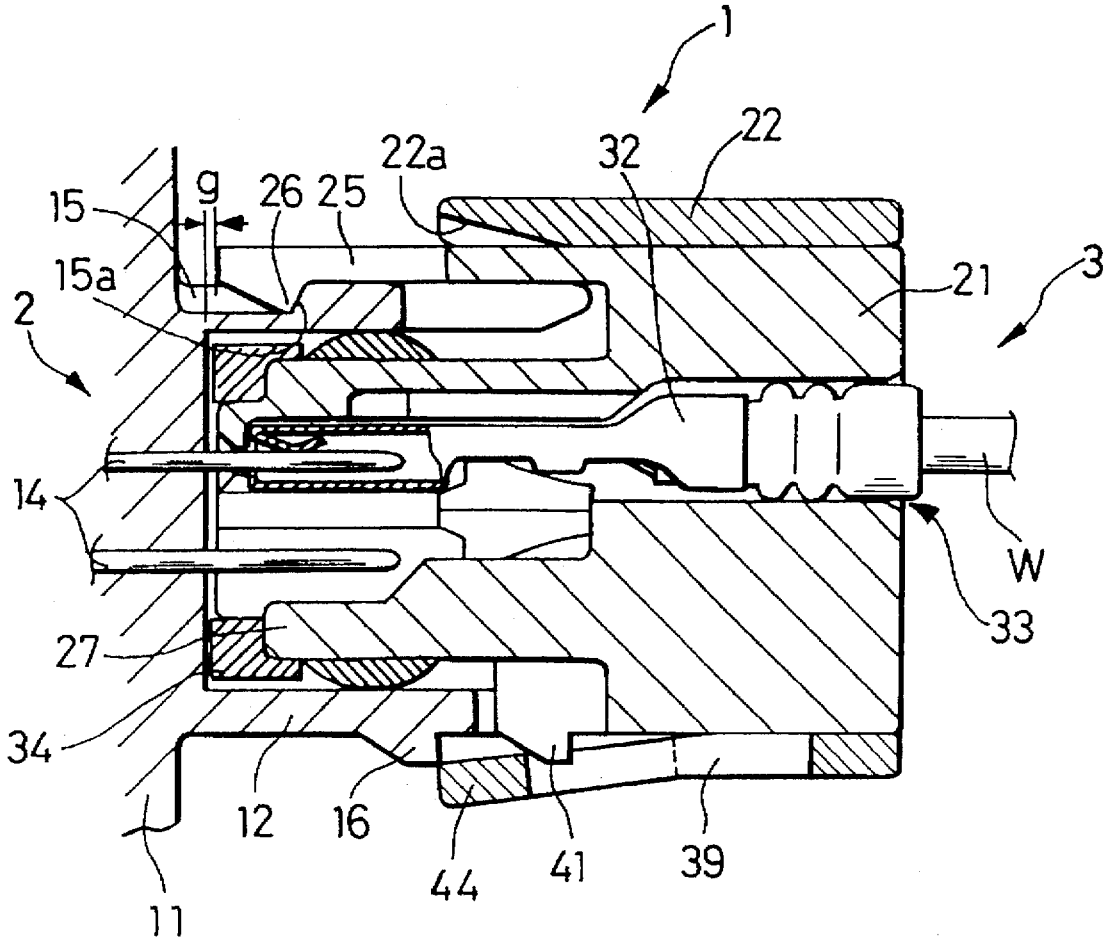
FIG. 11 is a sectional view showing the male and female connectors which have been completely engaged with each other.
Figure 12:
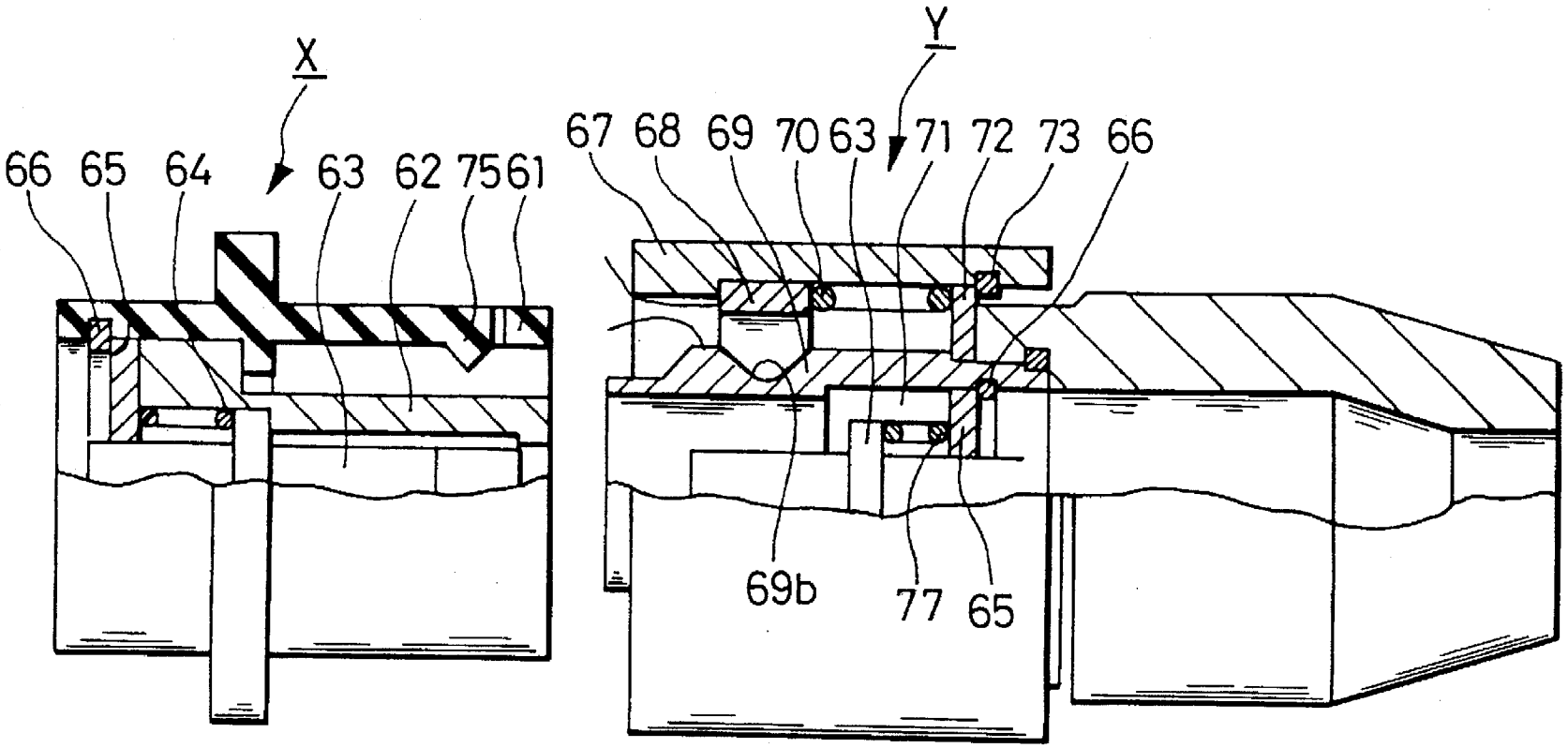
FIG. 12 is a sectional view showing a conventional connector engaging structure.

As, under the condition of FIG. 10, the inner housing 21 is further pushed to the left, as shown in FIG. 11 the engaging protrusion 26 formed at the end of the lock arm 25 is completely received in the engaging groove 15 formed in the cylindrical wall 12 of the male connector 2. As a result, the connector terminals 14 of the male connector 2 and the connector terminals 32 of the female connector 3 are electrically connected to one another. It is noted that the end face 15*a* of the engaging groove 15 is sloped; that is, it is so designed that the engaging protrusion 26 is smoothly slid into the engaging groove 15.

At the stage shown in FIG. 11, although the engaging protrusion 26 is engaged with the engaging groove 15, the cantilevered arm 44 rides slightly on the locking protrusion, and the upper portion of the lock arm 25 is not yet covered by the outer housing 22.

Hence, if, under this condition, the pushing of the inner housing 21 is suspended, the elastic force of the spring member 35 tends to move the inner housing 21 to the right. Since the upper portion of the lock arm 25 is not supported, the lock arm 25 will be deformed (deflected) upwardly, so that the engaging protrusion 26 will slide up the sloped surface 15*a* of the engaging groove 15, and be returned back to the right.

At the stage shown in FIG. 11, a gap g is formed between the surface of the base board 11 surrounded by the wall 12 and the front end of the inserting section 27. Hence, when the inner housing 21 is pushed to the left, the inner housing 21 is moved to the left in such a manner as to decrease the gap g, the cantilevered arm 44 is moved over the locking protrusion 16, and the locking protrusion 16 is received into the slide groove 39.

With the movement of the small distance g, the outer housing 22 together with the cantilevered arm 44 is moved, as a whole, to the left. As a result, the lock arm 25 is held down, and the engaging protrusion 26 is completely engaged with the engaging groove 15.

When the female connector 3 is engaged with the male connector 2 in the above-described manner, the end portion of the spring member 35, which is fitted in the engaging portion 36, is fixed so that the spring member forces the outer housing 22 to the left. Hence, the outer housing 22 is moved to the left by the resiliency of the spring member 35, thus covering the portion of the male connector 2 and the portion of the inner housing 22 which are overlapped. Thus, with the lock arm 25 completely held down, the male and female connectors have been completely engaged with each other.

In the above-described connector engaging structure 1, the rubber member 29 is pressed against the inner surface of the cylindrical wall 12 of the male connector 2. Hence, the connecting portions of the connector terminals 14 and 32 are held completely water-tight, which prevents the occurrence of electric leakage.

The male connector 2 is made of glass-mixed resin, and has no elastic portion. Hence, the male connector 2 is considerably high in mechanical strength. This feature as well as the above-described feature of preventing the incomplete engagement of the male and female connectors, improves the reliability of equipment or devices to which the connector engaging structure of the invention is applied.

As was described above, the connector engaging structure of the invention comprises: the first connector including the connector terminals fixedly secured to the base board which is directly mounted on a desired electronic device or the like, the cylindrical wall which surrounds the connector terminals, the engaging groove formed in one end portion of the outer cylindrical surface of the wall, and the locking protrusion formed on one end portion of the outer side surface of the wall; and the second connector including the inner housing having the connector terminals which are electrically connected to the connector terminals of the first connector, and the lock arm which, when the second connector is engaged with the first connector, engages with the engaging groove, and the outer housing which is slidable on the outer surface of the inner housing in the direction of engagement, and has a cantilevered arm which, when the second connector is engaged with the first connector, is locked to the locking protrusion. In the connector engaging structure, the inner housing has the cantilevered arm push-up protrusion at one end which releases the locking of the cantilevered arm to the locking protrusion during engagement.

Moreover, in the connector engaging structure, the sliding of the outer housing is effected by the spring member interposed between the inner housing and the outer housing.

Hence, if the engagement of the first and second connector is incomplete, the elastic force of the spring member removes the second connector from the first connector in the direction opposite to the direction of engagement. That is, it can be readily determined whether or not the first and second connectors have been completely engaged with each other. Hence, the incomplete engagement of the first and second connectors will never be mistaken for complete engagement, and the connector is positively prevented from unwanted removal.

In addition, the above-described feature makes it unnecessary to ensure that the connectors are completely engaged with each other, which improves the work efficiency.

What is claimed is:

1. A connector engaging structure comprising:

a first connector including:

a base portion secured to an electronic device;

connector terminals fixedly secured to said base portion;

a cylindrical wall protruding from said base portion and surrounding said connector terminals, said cylindrical wall having an engaging groove formed in one end portion thereof, and a locking protrusion formed on one end portion of an outer side surface of said wall; and a second connector including an inner housing including connector terminals which are electrically connectable to said connector terminals of said first connector, and a lock arm which, when said second connector is engaged with said first connector, engages with said engaging groove, and an outer housing which is slidable on the outer surface of said inner housing in a direction of engagement, said outer housing having a cantilevered arm which, when said second connector is engaged with said first connector, is locked to said locking protrusion, wherein said inner housing has a cantilevered arm push-up protrusion at one end thereof which releases the locking of said cantilevered arm to said locking protrusion during engagement.

2. The connector engaging structure of claim 1, wherein when said lock arm is engaged with said engaging groove, said outer housing is slid in the direction of engagement, to hold down said lock arm in said engaging groove.

3. The connector engaging structure of claim 1, further comprising a spring interposed between said inner housing and said outer housing for effectuating the sliding of said outer housing.

4. A connector engaging structure, comprising:

a first connector including a base portion secured to an electronic device;

connector terminals fixedly secured to said base portion;

a cylindrical wall protruding from said base portion and surrounding said connector terminals, said cylindrical wall having an engaging groove formed in one end portion thereof; and a locking protrusion formed on one end portion of an outer side surface of said wall; and a second connector engageable with said first connector by movement in an insertion direction, said second connector including an inner housing; an outer housing in which said inner housing is slidably disposed; and a spring interposed between said inner and outer housing for urging said inner housing in a direction opposite said insertion direction, wherein said inner housing includes connector terminals which are electrically connectable to said connector terminals of said first connector; a lock arm which, when said second connector is engaged with said first connector, engages with said engaging groove; and a push-up projection, wherein said outer housing includes a cantilevered arm which, when said second connector is completely engaged with said first connector, is climbed over said locking protrusion, wherein when said second connector is initially moved a predetermined distance in said insertion direction, said cantilevered arm abuts against said locking protrusion to thereby prevent further movement of said outer housing with respect to said inner housing in said insertion direction causing said spring to urge said inner housing in said opposite direction, and wherein further movement of said inner housing in said insertion direction causes said push-up projection to deflect said cantilevered arm beyond said lock protrusion allowing said outer housing to move in said insertion direction such that said cantilered arm engages said locking protrusion.

5. The connector engaging structure of claim 4, further comprising a seal for sealing said first and second connectors to prevent water from reaching said terminals.

6. The connector engaging structure of claim 4, wherein said said push-up projection includes an inclined surface.

7. The connector engaging structure of claim 4, wherein said outer housing prevents said lock arm from disengaging from said engaging groove when said cantilevered arm of said outer housing has climbed over said locking protrusion.

8. A connector engaging structure, comprising:

a first connector secured to an electronic device, said first connector including a base portion and a plurality of first terminals extending from said base portion;

a second connector engageable with said first connector by movement in an insertion direction, said second connector including:

an inner housing having a plurality of second terminals and including a locking arm which is engageabe with an engaging groove provided in said first connector, an outer housing slidably disposed with respect to said inner housing, said outer housing abutting against said locking arm when said inner housing is completely engaged with said first connector to prevent disengagement of said locking arm from said engaging groove, a spring interposed between said inner and outer housings for urging said inner housing in a direction opposite said insertion direction, preventing means for preventing said outer housing from moving in said insertion direction as said inner housing is moved a predetermined distance in said insertion direction such that said spring urges said inner housing in said oppposite direction, said preventing mean including a cantilevered arm extending from said outer housing and engaging said first connector, and disengaging means for disengaging said cantilevered arm from said first connector when said inner housing continues to move in said insertion direction thereby allowing said outer housing to move in said insertion direction to a locked position at which said outer housing abuts against said locking arm.

9. The connector engaging structure of claim 8, wherein said disengaging means is provided on said inner housing.

* * * * *